US006382526B1

(12) United States Patent
Reneker et al.

(10) Patent No.: US 6,382,526 B1
(45) Date of Patent: May 7, 2002

(54) PROCESS AND APPARATUS FOR THE PRODUCTION OF NANOFIBERS

(75) Inventors: Darrell H. Reneker, Akron, OH (US); Iksoo Chun, Flemington, NJ (US); Dale Ertley, Kent, OH (US)

(73) Assignee: The University of Akron, Akron, OH (US)

( * ) Notice: Subject to any disclaimer, the term of this patent is extended or adjusted under 35 U.S.C. 154(b) by 0 days.

(21) Appl. No.: 09/410,808

(22) Filed: Oct. 1, 1999

Related U.S. Application Data

(60) Provisional application No. 60/102,705, filed on Oct. 1, 1998.

(51) Int. Cl.[7] ..... B05B 1/28

(52) U.S. Cl. ..... 239/294; 239/424

(58) Field of Search ..... 239/290, 291, 239/294, 223, 424, 428, 416.4, 416.5, 135, 423; 264/12

(56) References Cited

U.S. PATENT DOCUMENTS

| | | | | |
|---|---|---|---|---|
| 4,167,548 A | | 9/1979 | Arduini et al. | 264/12 |
| 4,734,227 A | | 3/1988 | Smith | 264/13 |
| 4,815,660 A | | 3/1989 | Boger | 239/8 |
| 4,891,249 A | | 1/1990 | McIntyre | 427/421 |
| 5,273,212 A | * | 12/1993 | Gerhardus et al. | 239/424 |
| 5,421,921 A | | 6/1995 | Gill et al. | 156/62.4 |
| 5,476,616 A | | 12/1995 | Schwarz | 264/6 |
| 5,589,152 A | | 12/1996 | Tennent et al. | 423/447.3 |
| 5,613,637 A | | 3/1997 | Schmon | 239/296 |
| 5,617,997 A | * | 4/1997 | Kobayashi et al. | 239/424 |
| 5,654,040 A | | 8/1997 | Matsunaga | 427/420 |

FOREIGN PATENT DOCUMENTS

| | | | |
|---|---|---|---|
| DE | 195 43 606 A 1 | 5/1996 | D01D/4/02 |
| EP | 0 173 333 | 3/1986 | D01D/4/02 |
| FR | 2 054 358 | 4/1971 | D01D/5/00 |
| GB | 609167 | 3/1946 | |

OTHER PUBLICATIONS

"Nanofibers for Engineered Textiles" by Darrell H. Reneker, UMIST—Textiles Engineered for Performance, Apr. 20–22, 1998, 11 Pages.

"Man–Made Fibers" by R.W. Moncrieff, Wiley Interscience Division, John Wiley & Sons, Inc., pp. 690–693, 1970.

"Man–Made Fibers" by R.W. Moncrieff, A Halsted Press Book, John Wiley & Sons, Inc., pp. 797–799, 1975.

"Polypropylene Fibers—Science and Technology" by M. Ahmed, *Textile Science and Technology 5,* pp.434–461, 1982.

"Superfine Thermoplastic Fibers" by Van A. Wente, *Industrial and Engineering Chemistry,* vol. 48, No. 8, 1956.

* cited by examiner

*Primary Examiner*—Lisa Ann Douglas
(74) *Attorney, Agent, or Firm*—Renner, Kenner, Greive, Bobak, Taylor & Weber

(57) ABSTRACT

A process for forming nanofibers comprising the steps of feeding a fiber-forming material into an annular column, the column having an exit orifice, directing the fiber-forming material into an gas jet space, thereby forming an annular film of fiber-forming material, the annular film having an inner circumference, simultaneously forcing gas through a gas column, which is concentrically positioned within the annular column, and into the gas jet space, thereby causing the gas to contact the inner circumference of the annular film, and ejects the fiber-forming material from the exit orifice of the annular column in the form of a plurality of strands of fiber-forming material that solidify and form nanofibers having a diameter up to about 3,000 nanometers.

23 Claims, 3 Drawing Sheets

PROCESS AND APPARATUS FOR THE PRODUCTION OF NANOFIBERS

This application claims the benefit of pending U.S. Provisional Application No. 60/102,705 filed on Oct. 1, 1998.

This invention was made with government support under cooperative agreements awarded by the U.S. Army, U.S. Air Force, and the National Science Foundation. The government may have certain rights to the invention.

TECHNICAL FIELD

The present invention is directed toward a process and apparatus for the production of nanofibers. Specifically, the nanofibers are produced by a process utilizing pressurized gas, and the apparatus is specifically adapted to deliver fiber-forming material to a pressurized gas stream and thereby initiate the formation of nanofibers.

BACKGROUND OF THE INVENTION

Nanofiber technology has not yet developed commercially and therefore engineers and entrepreneurs have not had a source of nanofiber to incorporate into their designs. Uses for nanofibers will grow with improved prospects for cost-efficient manufacturing, and development of significant markets for nanofibers is almost certain in the next few years. The leaders in the introduction of nanofibers into useful products are already underway in the high performance filter industry. In the biomaterials area, there is a strong industrial interest in the development of structures to support living cells. The protective clothing and textile applications of nanofibers are of interest to the designers of sports wear, and to the military, since the high surface area per unit mass of nanofibers can provide a fairly comfortable garment with a useful level of protection against chemical and biological warfare agents.

Carbon nanofibers are potentially useful in reinforced composites, as supports for catalysts in high temperature reactions, heat management, reinforcement of elastomers, filters for liquids and gases, and as a component of protective clothing. Nanofibers of carbon or polymer are likely to find applications in reinforced composites, substrates for enzymes and catalysts, applying pesticides to plants, textiles with improved comfort and protection, advanced filters for aerosols or particles with nanometer scale dimensions, aerospace thermal management application, and sensors with fast response times to changes in temperature and chemical environment. Ceramic nanofibers made from polymeric intermediates are likely to be useful as catalyst supports, reinforcing fibers for use at high temperatures, and for the construction of filters for hot, reactive gases and liquids.

It is known to produce nanofibers by using electrospinning techniques. These techniques, however, have been problematic because some spinnable fluids are very viscus and require higher forces than electric fields can supply before sparking occurs, i.e., there is a dielectric breakdown in the air. Likewise, these techniques have been problematic where higher temperatures are required because high temperatures increase the conductivity of structural parts and complicate the control of high electrical fields.

It is known to use pressurized gas to create polymer fibers by using melt-blowing techniques. According to these techniques, a stream of molten polymer is extruded into a jet of gas. These polymer fibers, however, are rather large in that the fibers are greater than 1,000 nanometers in diameter and more typically greater than 10,000 nanofibers in diameter. It is also known to combine electrospinning techniques with melt-blowing techniques. But, the combination of an electric field has not proved to be successful in producing nanofibers inasmuch as an electric field does not produce stretching forces large enough to draw the fibers because the electric fields are limited by the dielectric breakdown strength of air.

Many nozzles and similar apparatus that are used in conjunction with pressurized gas are also known in the art. For example, the art for producing small liquid droplets includes numerous spraying apparatus including those that are used for air brushes or pesticide sprayers. But, there are no apparatus or nozzles capable of producing nanofibers.

SUMMARY OF INVENTION

It is therefore an object of the present invention to provide a method for forming nanofibers.

It is another object of the present invention to provide a method for forming nanofibers having a diameter less than about 3,000 nanometers.

It is a further object of the present invention to provide an economical and commercially viable method for forming nanofibers.

It is still another object of the present invention to provide a nozzle that, in conjunction with pressurized gas, produces nanofibers.

It is yet another object of the present invention to provide a method for forming nanofibers from fiber-forming polymers.

It is still yet another object of the present invention to provide a method for forming nanofibers from fiber-forming ceramic precursors.

It is still yet another object of the present invention to provide a method for forming nanofibers from fiber-forming carbon precursors.

It is another object of the present invention to provide a method for forming nanofibers by using pressurized gas.

It is another object of the present invention to provide a method for the formation of acicular nanofibers.

It is another object of the present invention to provide a method for the formation of acicular nanofibers having a length up to about 20,000 nanometers, and having a diameter less than about 3000 nanometers.

It is yet another object of the present invention to provide a nozzle that, in conjunction with pressurized gas, produces nanofibers having a diameter less than about 3,000 nanometers.

At least one or more of the foregoing objects, together with the advantages thereof over the known art relating to the manufacture of nanofibers, will become apparent from the specification that follows and are accomplished by the invention as hereinafter described and claimed.

In general the present invention provides a process for forming nanofibers comprising the steps of feeding a fiber-forming material into an annular column, the column having an exit orifice, directing the fiber-forming material into an gas jet space, thereby forming an annular film of fiber-forming material, the annular film having an inner circumference, simultaneously forcing gas through a gas column, which is concentrically positioned within the annular column, and into the gas jet space, thereby causing the gas to contact the inner circumference of the annular film, and ejects the fiber-forming material from the exit orifice of the annular column in the form of a plurality of strands of fiber-forming material that solidify and form nanofibers having a diameter up to about 3,000 nanometers.

The present invention also includes a nozzle for forming nanofibers by using a pressurized gas stream comprising a center tube, a supply tube that is positioned concentrically around and apart from said center tube, wherein said center tube and said supply tube form an annular column, and wherein said center tube is positioned within said supply tube so that an gas jet space is created between a lower end of said center tube and a lower end of said supply tube.

PREFERRED EMBODIMENT FOR CARRYING OUT THE INVENTION

Figure 1:
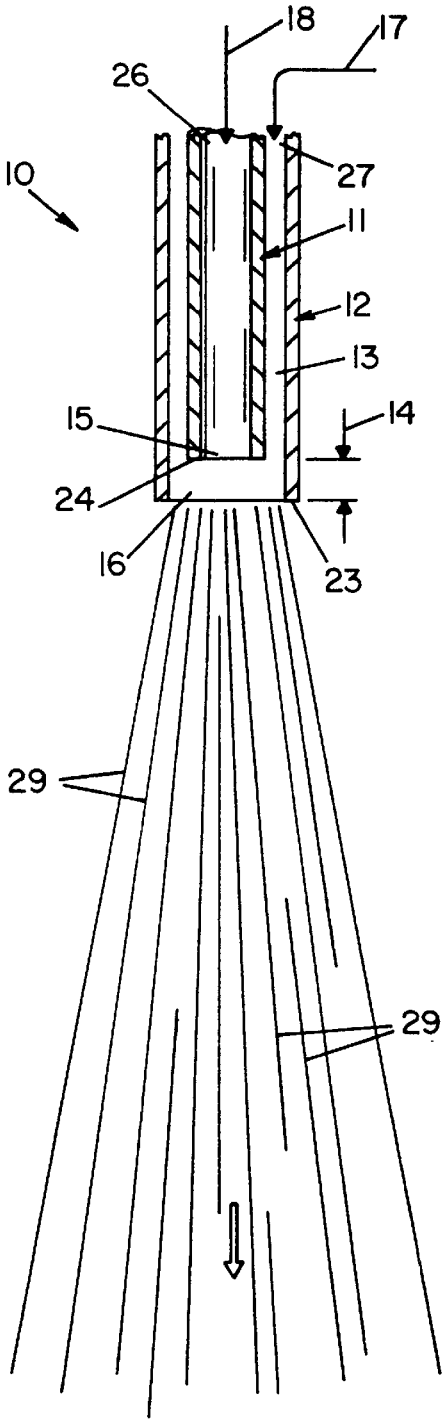
FIG. 1 is a schematic diagram of an apparatus for producing nanofibers according to this invention.

It has now been found that nanofibers can be produced by using pressurized gas. This is generally accomplished by a process wherein the mechanical forces supplied by an expanding gas jet create nanofibers from a fluid that flows through a nozzle. This process may be referred to as nanofibers by gas jet (NGJ). NGJ is a broadly applicable process that produces nanofibers from any spinnable fluid or fiber-forming material.

In general, a spinnable fluid or fiber-forming material is any fluid or material that can be mechanically formed into a cylinder or other long shapes by stretching and then solidifying the liquid or material. This solidification can occur by, for example, cooling, chemical reaction, coalescence, or removal of a solvent. Examples of spinnable fluids include molten pitch, polymer solutions, polymer melts, polymers that are precursors to ceramics, and molten glassy materials. Some preferred polymers include nylon, fluoropolymers, polyolefins, polyimides, polyesters, and other engineering polymers or textile forming polymers. The terms spinnable fluid and fiber-forming material may be used interchangeably throughout this specification without any limitation as to the fluid or material being used. As those skilled in the art will appreciate, a variety of fluids or materials can be employed to make fibers including pure liquids, solutions of fibers, mixtures with small particles and biological polymers.

A preferred nozzle 10 that is employed in practicing the process of this invention is best described with reference to FIG. 1. Nozzle 10 includes a center tube 11 having an entrance orifice 26 and an outlet orifice 15. The diameter of center tube 11 can vary based upon the need for gas flow, which impacts the velocity of the gas as it moves a film of liquid across the jet space 14, as will be described below. In a preferred embodiment, the diameter of tube 11 is from about 0.5 to about 10 mm, and more preferably from about 1 to about 2 mm. Likewise, the length of tube 11 can vary depending upon construction conveniences, heat flow considerations, and shear flow in the fluid. In a preferred embodiment, the length of tube 11 will be from about 1 to about 20 cm, and more preferably from about 2 to about 5 cm. Positioned concentrically around and apart from the center tube 11 is a supply tube 12, which has an entrance orifice 27 and an outlet orifice 16. Center tube 11 and supply tube 12 create an annular space or column 13. This annular space or column 13 has a width, which is the difference between the inner and outer diameter of the annulus, that can vary based upon the viscosity of the fluid and the maintenance of a suitable thickness of fiber-forming material fluid on the inside wall of gas jet space 14. In a preferred embodiment, the width is from about 0.05 to about 5 mm, and more preferably from about 0.1 to about 1 mm. Center tube 11 is vertically positioned within supply tube 12 so that a gas jet space 14 is created between lower end 24 of center tube 11 and lower end 23 of supply tube 12. The position of center tube 11 is adjustable relative to lower end 23 of supply tube 12 so that the length of gas jet space 14 is adjustable. Gas jet space 14, i.e., the distance between lower end 23 and lower end 24, is adjustable so as to achieve a controlled flow of fluid along the inside of tube 12, and optimal conditions for nanofiber production at the end 23 of tube 12. In one embodiment, this distance is from about 0.1 to about 10 mm, and more preferably from about 1 to about 2 mm. It should be understood that gravity will not impact the operation of the apparatus of this invention, but for purposes of explaining the present invention, reference will be made to the apparatus as it is vertically positioned as shown in the figures.

It should be appreciated that the supply tube outlet orifice 16 and gas jet space 14 can have a number of different shapes and patterns. For example, the space 14 can be shaped as a cone, bell, trumpet, or other shapes to influence the uniformity of fibers launched at the orifice. The shape of the outlet orifice 16 can be circular, elliptical, scalloped, corrugated, or fluted. Still further, the inner wall of supply tube 12 can include slits or other manipulations that may alter fiber formation. These shapes influence the production rate and the distribution of fiber diameters in various ways.

According to the present invention, nanofibers are produced by using the apparatus of FIG. 1 by the following method. Fiber-forming material is provided by a source 17, and fed through annular space 13. The fiber-forming material is directed into gas jet space 14. Simultaneously, pressurized gas is forced from a gas source 18 through the center tube 11 and into the gas jet space 14.

Within gas jet space 14 it is believed that the fiber-forming material is in the form of an annular film. In other words, fiber-forming material exiting from the annular space 13 into the gas jet space 14 forms a thin layer of fiber-forming material on the inside wall of supply tube 12 within gas jet space 14. This layer of fiber-forming material is subjected to shearing deformation by the gas jet exiting from center tube outlet orifice 15 until it reaches the fiber-forming material supply tube outlet orifice 16. At this point, it is believed that the layer of fiber-forming material is blown apart into many small strands 29 by the expanding gas and ejected from orifice 16 as shown in FIG. 1. Once ejected from orifice 16, these strands solidify and form nanofibers. This solidification can occur by cooling, chemical reaction, coalescence, ionizing radiation or removal of solvent.

As noted above, the fibers produced according to this process are nanofibers and have an average diameter that is less than about 3,000 nanometers, more preferably from about 3 to about 1,000 nanometers, and even more preferably from about 10 to about 500 nanometers. The diameter of these fibers can be adjusted by controlling various conditions including, but not limited to, temperature and gas pressure. The length of these fibers can widely vary to include fibers that are as short as about 0.01 mm up to those fibers that are about many km in length. Within this range, the fibers can have a length from about 1 mm to about 1 km, and more narrowly from about 1 cm to about 1 mm. The length of these fibers can be adjusted by controlling the solidification rate.

As discussed above, pressurized gas is forced through center tube 11 and into jet space 14. This gas should be forced through center tube 11 at a sufficiently high pressure so as to carry the fiber forming material along the wall of jet space 14 and create nanofibers. Therefore, in one preferred embodiment, the gas is forced through center tube 11 under a pressure of from about 10 to about 5,000 psi, and more preferably from about 50 to about 500 psi.

The term gas as used throughout this specification, includes any gas. Non-reactive gases are preferred and refer to those gases, or combinations thereof, that will not deleteriously impact the fiber-forming material. Examples of these gases include, but are not limited to, nitrogen, helium, argon, air, nitrogen, helium, argon, air, carbon dioxide, steam fluorocarbons, fluorochlorocarbons, and mixtures thereof. It should be understood that for purposes of this specification, gases will refer to those super heated liquids that evaporate at the nozzle when pressure is released, e.g., steam. It should further be appreciated that these gases may contain solvent vapors that serve to control the rate of drying of the nanofibers made from polymer solutions. Still further, useful gases include those that react in a desirable way, including mixtures of gases and vapors or other materials that react in a desirable way. For example, it may be useful to employ oxygen to stabilize the production of nanofibers from pitch. Also, it may be useful to employ gas streams that include molecules that serve to crosslink polymers. Still further, it may be useful to employ gas streams that include metals that serve to improve the production of ceramics.

Figure 2:
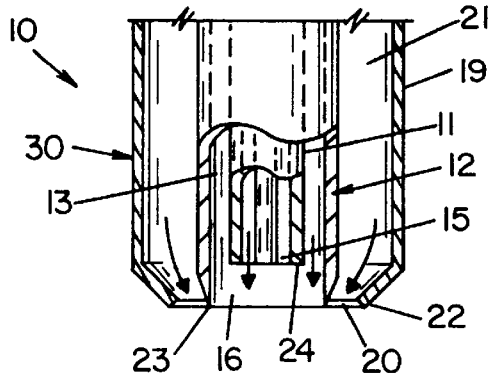
FIG. 2 is a schematic representation of a preferred embodiment of the apparatus of this invention, wherein the apparatus includes a lip cleaner assembly.
Figure 3:
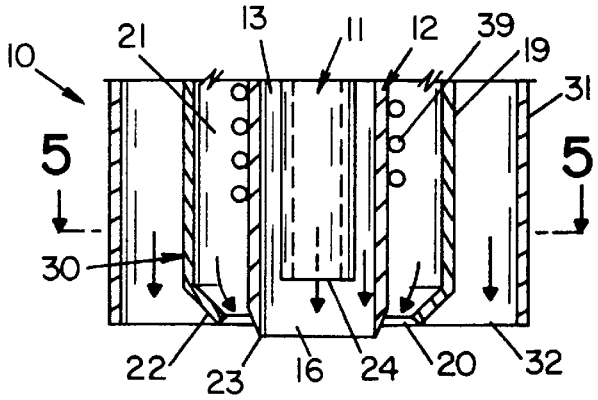
FIG. 3 is a schematic representation of a preferred embodiment of the apparatus of this invention, wherein the apparatus includes an outer gas shroud assembly.
Figure 4:
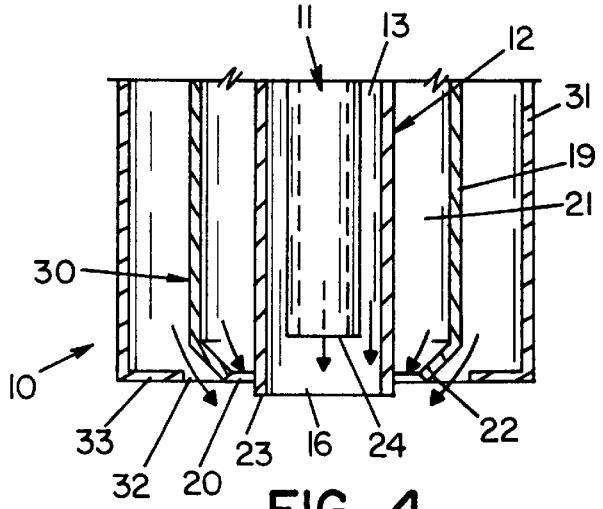
FIG. 4 is a schematic representation of a preferred embodiment of the apparatus of the invention, wherein the apparatus includes an outer gas shroud, and the shroud is modified with a partition.

In a more preferred embodiment, shown in FIG. 2, nozzle 10 further comprises a lip cleaner 30. Within this assembly, an outer gas tube 19 is positioned concentrically around and apart from supply tube 12. Outer gas tube 19 extends along supply tube 12 and thereby creates a gas annular column 21. Lower end 22 of gas annular column 21 and lower end 23 of supply tube 12 form lip cleaner orifice 20. In one embodiment, lower end 22 and lower end 23 are on the same horizontal plane (flush) as shown in FIG. 2. In another embodiment, however, lower ends 22 and 23 may be on different horizontal planes as shown in FIGS. 3 and 4. As also shown in FIG. 2 outer gas tube 19 preferably tappers and thereby reduces the size of annular space 21. Pressurized gas is forced through outer gas tube 19 and exits from outer gas tube 19 at lip cleaner orifice 20, thereby preventing the build up of residual amounts of fiber-forming material that can accumulate at lower end 23 of supply tube 12. The gas that is forced through gas annular column 21 should be at a sufficiently high pressure so as to prevent accumulation of excess fiber-forming material at lower end 23 of supply tube 12, yet should not be so high that it disrupts the formation of fibers. Therefore, in one preferred embodiment, the gas is forced through the gas annular column 21 under a pressure of from about 0 to about 1,000 psi, and more preferably from about 10 to about 100 psi. The gas flow through lip cleaner orifice 20 also affects the exit angle of the strands of fiber-forming material exiting from outlet orifice 15, and therefore lip cleaner 30 of this environment serves both to clean the lip and control the flow of exiting fiber strands.

Figure 5:
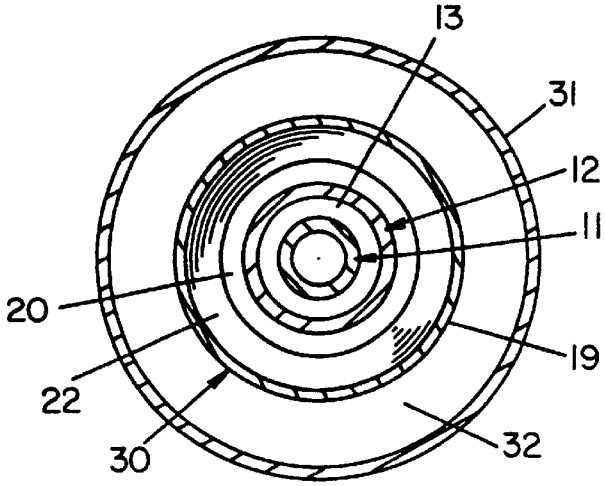
FIG. 5 is a cross sectional view taken along line 5—5 of the embodiment shown in FIG. 3.

In yet another preferred embodiment, which is shown in FIGS. 3, 4, and 5, a shroud gas tube 31 is positioned concentrically around outer gas tube 19. Pressurized gas at a controlled temperature is forced through shroud gas tube 31 so that it exits from the shroud gas tube orifice 32 and thereby creates a moving shroud of gas around the nanofibers. This shroud of gas controls the cooling rate, solvent evaporation rate of the fluid, or the rate chemical reactions occurring within the fluid. It should be understood that the general shape of the gas shroud is controlled by the width of the annular tube orifice 32 and its vertical position with respect to bottom 23 of tube 12. The shape is further controlled by the pressure and volume of gas flowing through the shroud. It should be further understood that the gas flowing through the shroud is preferably under a relatively low pressure and at a relatively high volume flow rate in comparison with the gas flowing through center tube 11.

In one embodiment, shroud gas tube orifice 32 is in an open configuration, as shown in FIG. 3. In another embodiment, as shown in FIG. 4, orifice 32 is in a constricted configuration, wherein the orifice is partially closed by a shroud partition 33 that adjustably extends from shroud gas tube 31 toward lower end 23.

Figure 6:
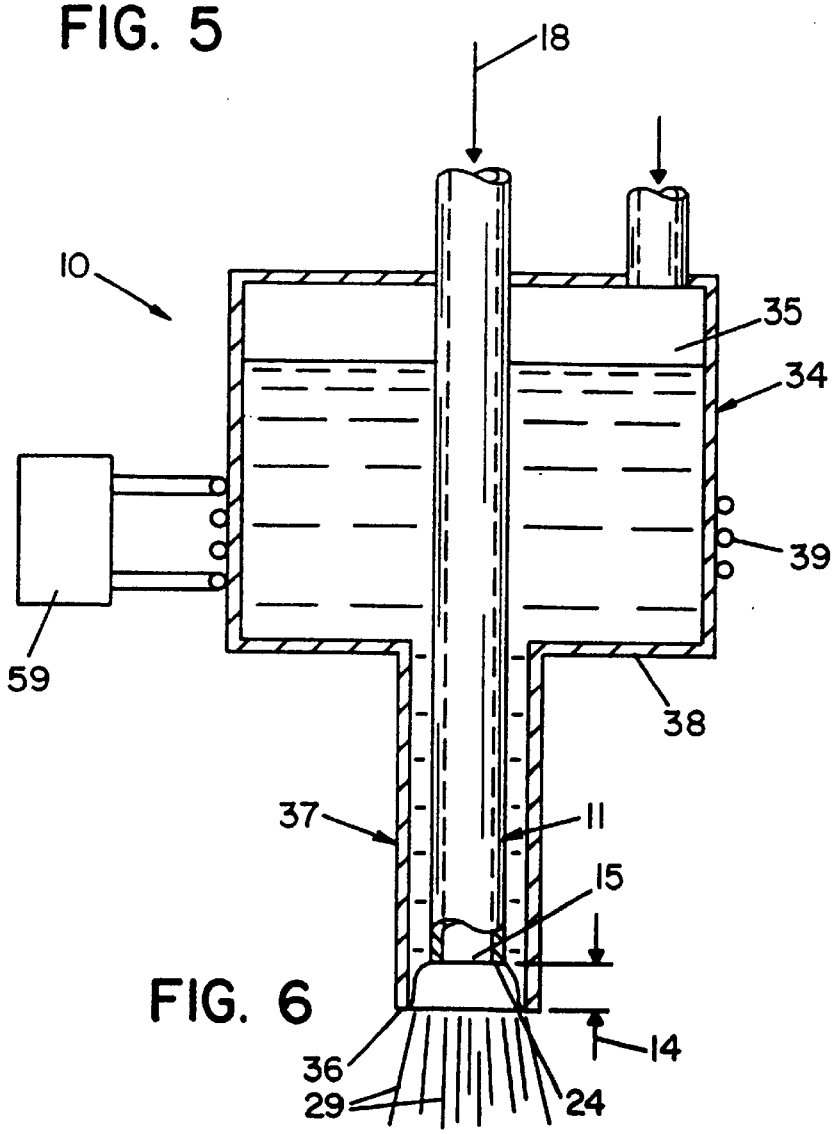
FIG. 6 is a schematic representation of a preferred embodiment of the apparatus of this invention wherein the apparatus is designed for batch processes.

In practicing the present invention, spinnable fluid or fiber-forming material can be delivered to annular space 13 by several techniques. For example, and as shown in FIG. 6, the fiber-forming material can be stored within nozzle 10. This is especially useful for batch operations. As with the previous embodiments, nozzle 10 will include a center tube 11. Positioned, preferably concentrically, around center tube 11 is a fiber-forming material container 34, comprising container walls 38, and defining a storage space 35. The size of storage space 35, and therefore the volume of spinnable fluid stored within it, will vary according to the particular application to which the present invention is put. Fiber-forming material container 34 further comprises a supply tube 12. Center tube 11 is inserted into fiber-forming material container 34 in such a way that a center tube outlet orifice 15 is positioned within the outlet tube 37, creating an gas jet space 14 between the lower end 24 of center outlet 11 and the lower end 36 of outlet tube 37. The position of center tube 11 is vertically adjustable relative to lower end 36 so that the length of the gas jet space 14 is likewise adjustable. As with previously described embodiments, gas jet space 14, i.e., the distance between lower end 36 and lower end 24, is adjustable so as to achieve a uniform film within space 14 and thereby produce uniform fibers with small diameters and high productivity. In one embodiment, this distance is from about 1 to about 2 mm, and more preferably from about 0.1 to about 5 mm. The length of outlet tube 37 can be varied according to the particular application of the present invention. If container wall 38 is of sufficient thickness, such that a suitable gas jet space can be created within wall 38, then outlet tube 37 may be eliminated.

According to this embodiment, nanofibers are produced by using the apparatus of FIG. 6 according to the following method. Pressure is applied to the container so that fiber-forming material is forced from storage space 35 into gas jet space 14. The pressure that is applied can result form gas pressure, pressurized fluid, or molten polymer from an extruder. Simultaneously, pressurized gas is forced from a gas source 18, through center tube 11, and exits through center tube orifice 15 into gas jet space 14. As with previous embodiments, heat may be applied to the fiber-forming material prior to or after being placed in fiber-forming material container 34, to the pressurized gas entering center tube 11, and/or to storage space 35 by heat source 39 or additional heat sources. Fiber-forming material exiting from storage space 35 into gas jet space 14 forms a thin layer of fiber-forming material on the inside wall of gas jet space 14. This layer of fiber-forming material is subjected to shearing deformation, or other modes of deformation such as surface wave, by the gas jet until it reaches container outlet orifice 36. There the layer of fiber-forming material is blown apart, into many small strands, by the expanding gas.

Figure 7:
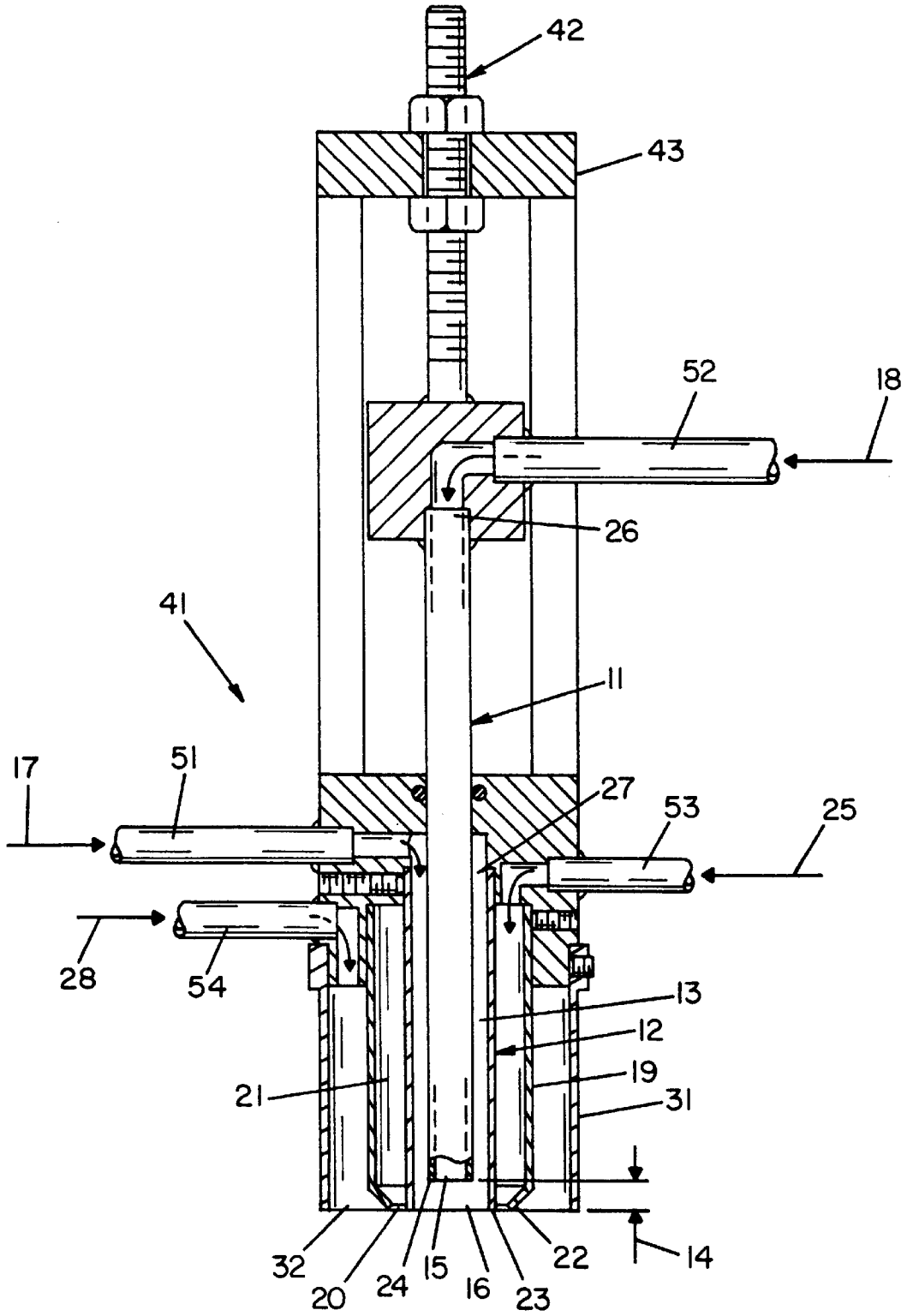
FIG. 7 is a schematic representation of a preferred embodiment of the apparatus of this invention wherein the apparatus is designed for continuous processes.

In still another preferred embodiment, as shown in FIG. 7, the fiber-forming material can be delivered on a continuous basis rather than a batch basis as in FIG. 6. In this embodiment, the apparatus is a continuous flow nozzle 41. Consistent with previous embodiments, nozzle 41 comprises a center tube 11, a supply tube 12, an outer gas tube 19, and an gas shroud tube 31. Supply tube 12 is positioned concentrically around center tube 11. Outer gas tube 19 is positioned concentrically around supply tube 12. Gas shroud tube 31 is positioned concentrically around outer gas tube 19. Center tube 11 has an entrance orifice 26 and an outlet orifice 15. As in previous embodiments, the diameter of center tube 11 can vary. In a preferred embodiment, the diameter of tube 11 is from about 1 to about 20 mm, and more preferably from about 2 to about 5 mm. Likewise the length of tube 11 can vary. In a preferred embodiment, the length of tube 11 will be from about 2 to about 3 cm, and more preferably from about 1 to about 10 cm.

Positioned concentrically around the center tube 11 is a supply tube 12 that has an entrance orifice 27 and an outlet orifice 16. The center tube 11 and supply tube 12 create an annular space or column 13. This annular space or column 13 has a width, which is the difference between the inner and outer diameter of the annulus, that can vary. In a preferred embodiment, the width is from about 0.05 to about 5 mm, and more preferably from about 0.1 to about 1 mm.

Center tube 11 is vertically positioned within the supply tube 12 so that an gas jet space 14 is created between the lower end 24 of center tube 11 and the lower end 23 of supply tube 12. The position of center tube 11 is adjustable relative to supply tube outlet orifice 16 so that the size of gas jet space 14 is adjustable. As with previously embodiments, the gas jet space 14, i.e., the distance between lower end 23 and lower end 24, is adjustable. In one embodiment this distance is from about 0.1 to about 10 mm, and more preferably from about 1 to about 2 mm.

Center tube 11 is attached to an adjustment device 42 that can be manipulated such as by mechanical manipulation. In one particular embodiment as shown in FIG. 7, the adjustment device 42 is a threaded rod that is inserted through a mounting device 43 and is secured thereby by a pair of nuts threaded onto the rod.

In this embodiment, supply tube 12 is in fluid tight communication with supply inlet tube 51. Center tube 11 is in fluid tight communication with pressurized gas inlet tube 52, outer gas tube 19 is in fluid tight communication with the lip cleaner gas inlet tube 53, and gas shroud tube 31 is in fluid tight communication with shroud gas inlet tube 54. This fluid tight communication is achieved by use of a connector, but other means of making a fluid tight communication can be used, as known by those skilled in the art.

According to the present invention, nanofibers are produced by using the apparatus of FIG. 7 by the following method. Fiber-forming material is provided by a source 17 through supply inlet tube 51 into and through annular space 13, and then into gas jet space 14. Preferably the fiber-forming material is supplied to the supply inlet tube 51 under a pressure of from about 0 to about 15,000 psi, and more preferably from about 100 to about 1,000 psi. Simultaneously, pressurized gas is forced through inlet tube 52, through center tube 11, and into gas jet space 14. As with previously described embodiments, it is believed that fiber-forming material is in the form of an annular film within gas jet space 14. This layer of fiber-forming material is subjected to shearing deformation by the gas jet exiting from the center tube outlet orifice 15 until it reaches the fiber-forming material supply tube outlet orifice 16. At this point, it is believed that the layer of fiber-forming material is blown apart into many small strands by the expanding gas. Once ejected from orifice 16, these strands solidify in the form of nanofibers. This solidification can occur by cooling, chemical reaction, coalescence, ionizing radiation or removal of solvent. As with previously described embodiments also simultaneously, pressurized gas is supplied by gas source 25 to lip cleaner inlet tube 53 into outer gas tube 19.

As with previous embodiments, the outer gas tube 19 extends along supply tube 12 and thereby creates an annular column of gas 21. The lower end 22 of gas annular column 21 and the lower end 23 of supply tube 12 form a lip cleaner orifice 20. In this embodiment, lower end 22 and lower end 23 are on the same horizontal plane (flush) a shown in FIG. 7. As noted above, however, lower ends 22 and 23 may be on different horizontal planes. The pressurized of gas exiting through lip cleaner orifice 20 prevents the buildup of residual amounts of fiber-forming material that can accumulate at lower end 23 of supply tube 12. Simultaneously, pressurized gas is supplied by gas source 28 through shroud gas inlet tube 54 to shroud gas tube 31. Pressurized gas is forced through the shroud gas tube 31 and it exits from the shroud gas tube orifice 32 thereby creating a shroud of gas around the nanofibers that control the cooling rate of the nanofibers exiting from tube orifice 16. In one particular embodiment, fiber-forming material is supplied by an extruder.

It should be understood that there are many of conditions and parameters that will impact the formation of fibers according to the present invention. For example, the pressure of the gas moving through any of the columns of the apparatus of this invention may need to be manipulated based on the fiber-forming material that is employed. Also, the fiber-forming material being used or the desired characteristics of the resulting nanofiber may require that the fiber-forming material itself or the various gas streams be heated. For example, the length of the nanofibers can be adjusted by varying the temperature of the shroud air. Where the shroud air is cooler, thereby causing the strands of fiber-forming material to quickly freeze or solidify, longer nanofibers can be produced. On the other hand, where the shroud air is hotter, and thereby inhibits solidification of the strands of fiber-forming material, the resulting nanofibers will be shorter in length. It should also be appreciated that the temperature of the pressurized gas flowing through tube 11 can likewise be manipulated to achieve or assist in these results. For example, acicular nanofibers of mesophase pitch can be produced where the shroud air is maintained at about 350° C. This temperature should be carefully controlled so that it is hot enough to cause the strands of mesophase pitch to be soft enough and thereby stretch and neck into short segments, but not too hot to cause the strands to collapse into droplets. Preferred acicular nanofibers have lengths in the range of about 1,000 to about 2,000 nanometers.

Those skilled in the art will be able to heat the various gas flows using techniques that are conventional in the art. Likewise, the fiber-forming material can be heated by using techniques well known in the art. For example, heat may be applied to the fiber-forming material entering the supply tube, to the pressurized gas entering the center tube, or to the supply tube itself by a heat source 39, as shown in FIGS. 3 and 6, for example. In one particular embodiment, as shown in FIG. 6, heat source 39 can include coils that are heated by a source 59.

In one specific embodiment the present invention, carbon nanofiber precursors are produced. Specifically, nanofibers of polymer, such as polyacrylonitrile, are spun and collected by using the process and apparatus of this invention. These polyacrylonitrile fibers are heated in air to a temperature of about 200 to about 400° C. under tension to stabilize them for treatment at higher temperature. These stabilized fibers are then converted to carbon fibers by heating to approximately 1700° C. under inert gas. In this carbonization process, all chemical groups, such as HCN, $NH_3$, $CO_2$, $N_2$ and hydrocarbons, are removed. After carbonization, the fibers are heated to temperatures in the range of about 2000° C. to about 3000° C. under tension. This process, called graphitization, makes carbon fibers with aligned graphite crystallites.

In another specific embodiment, carbon nanofiber precursors are produced by using mesophase pitch. These pitch fibers can then be stabilized by heating in air to prevent melting or fusing during high temperature treatment, which is required to obtain high strength and high modulus carbon fibers. Carbonization of the stabilized fibers is carried out at temperatures between 1000° C. and 1700° C. depending on the desired properties of the carbon fibers.

In another embodiment, NGJ is combined with electrospinning techniques. In these combined process, NGJ improves the production rate while the electric field maintains the optimal tension in the jet to produce orientation and avoid the appearance of beads on the fibers. The electric field also provides a way to direct the nanofibers along a desired trajectory through processing machinery, heating ovens, or to a particular position on a collector. Electrical charge on the fiber can also produce looped and coiled nanofibers that can increase the bulk of the non-woven fabric made from these nanofibers.

Nanofibers can be combined into twisted yarns with an gas vortex. Also, metal containing polymers can be spun into nanofibers and converted to ceramic nanofibers. This is a well known route to the production of high quality ceramics. The sol-gel process utilizes similar chemistry, but here linear polymers would be synthesized and therefore gels would be avoided. In some applications, a wide range of diameters would be useful. For example, in a sample of fibers with mixed diameters, the volume-filling factor can be higher because the smaller fibers can pack into the interstices between the larger fibers.

Blends of nanofibers and textile size fibers may have properties that would, for example, allow a durable non-woven fabric to be spun directly onto a person, such as a soldier or environmental worker, to create protective clothing that could absorb, deactivate, or create a barrier to chemical and biological agents.

It should also be appreciated that the average diameter and the range of diameters is affected by adjusting the gas temperature, the flow rate of the gas stream, the temperature of the fluid, and the flow rate of fluid. The flow of the fluid can be controlled by a valve arrangement, by an extruder, or by separate control of the pressure in the container and in the center tube, depending on the particular apparatus used.

It should thus be evident that the NGJ methods and apparatus disclosed herein are capable of providing nanofibers by creating a thin layer of fiber-forming material on the inside of an outlet tube, and this layer is subjected to shearing deformation until it reaches the outlet orifice of the tube. There, the layer of fiber-forming material is blown apart, into many small jets, by the expanding gas. No apparatus has ever been used to make nanofibers by using pressurized gas. Further, the NGJ process creates fibers from spinnable fluids, such as mesophase pitch, that can be converted into high strength, high modulus, high thermal conductivity graphite fibers. It can also produce nanofibers from a solution or melt. It may also lead to an improved nozzle for production of small droplets of liquids. It should also be evident that NGJ produces nanofibers at a high production rate. NGJ can be used alone or in combination with either or both melt blowing or electrospinning to produce useful mixtures of fiber geometries, diameters and lengths. Also, NGJ can be used in conjunction with an electric field, but it should be appreciated that an electric field is not required.

What is claimed is:

1. A process for forming nanofibers comprising the steps of:

feeding a fiber-forming material into an annular column, the column having an exit orifice;

directing the fiber-forming material into an gas jet space, thereby forming an annular film of fiber-forming material, the annular film having an inner circumference;

simultaneously forcing gas through a gas column, which is concentrically positioned within the annular column, and into the gas jet space, thereby causing the gas to contact the inner circumference of the annular film, and ejects the fiber-forming material from the exit orifice of the annular column in the form of a plurality of strands of fiber-forming material that solidify and form nanofibers having a diameter up to about 3,000 nanometers.

2. The process of claim 1, further comprising the step of feeding a cleaner gas through an outer gas column, which is positioned concentrically around and apart from the annular column, where the cleaner as exits the outer gas column at a cleaner orifice that is positioned approximate to the exit orifice, the exit of the cleaner as thereby preventing the build-up of residual amounts of fiber-forming material at the exit orifice.

3. The process of claim 1, further comprising the step of feeding a shroud gas into a shroud column, which is positioned concentrically around and apart from the annular column, where the shroud gas exits the shroud orifice that surrounds the exit orifice, the exit of the shroud gas thereby controlling the cooling rate of the fiber-forming material being ejected from the exit orifice.

4. The process of claim 1, further comprising the step of directing the plurality of strands of fiber-forming material exiting from the exit orifice into an electric field.

5. A nozzle for forming nanofibers by using a pressurized gas stream, said nozzle comprising:

a center tube;

a supply tube that is positioned concentrically around and apart from said center tube, wherein said center tube and said supply tube form an annular column, and wherein said center tube is positioned within said supply tube so that a gas jet space is created between a lower end of said center tube and a lower end of said supply tube, wherein said gas jet space has a length that is adjustable.

6. The nozzle of claim 5, wherein said gas jet space has a length of about 0.1 to about 10 millimeters.

7. The nozzle of claim 5, wherein said gas jet space has a length of about 1 to about 2 millimeters.

8. The nozzle of claim 5, wherein said annular column is adapted to carry a fiber forming material.

9. The nozzle of claim 5, wherein said center tube is adapted to carry a pressurized gas.

10. The nozzle of claim 9, wherein said pressurized gas is selected from the group consisting of nitrogen, helium, argon, air, carbon dioxide, steam fluorocarbons, fluorochlorocarbons, and mixtures thereof.

11. The nozzle of claim 5, wherein said center tube is adapted to carry a pressurized gas at a pressure of from about 10 to about 5000 pounds per square inch.

12. The nozzle of claim 11, wherein said center tube is adapted to carry a pressurized gas at a pressure of from about 50 to about 500 pounds per square inch.

13. The nozzle of claim 5, wherein said center tube and said supply tube are essentially parallel to each other.

14. The nozzle of claim 13, further comprising an outer gas tube having an inlet orifice and an outlet orifice, wherein the outer gas tube is positioned concentrically around said supply tube, thereby creating a gas annular column.

15. A nozzle for forming nanofibers by using a pressurized gas stream comprising:

a center tube;

a supply tube that is positioned concentrically around and apart from said center tube, wherein said center tube and said supply tube form an annular column, and wherein said center tube is positioned within said supply tube so that an gas jet space is created between a lower end of said center tube and a lower end of said supply tube; and an outer gas tube having an inlet orifice and an outlet orifice, wherein the outer gas tube is positioned concentrically around said supply tube, thereby creating a gas annular column.

16. The nozzle of claim 15, wherein said outer gas tube has a lower end which is on an identical horizontal plane as a lower end of said supply tube.

17. The nozzle of claim 15, wherein said outer gas tube has a lower end which is on a different horizontal plane as a lower end of said supply tube.

18. The nozzle of claim 15, wherein said outer gas tube is adapted to carry a pressurized gas at a pressure of from 0 to about 1,000 pounds per square inch.

19. The nozzle of claim 15, wherein said outer gas tube is adapted to carry a pressurized gas at a pressure of from 10 to about 100 pounds per square inch.

20. The nozzle of claim 15, further comprising a gas shroud tube having an inlet orifice and an outlet orifice, wherein said gas shroud tube is positioned concentrically around said outer gas tube.

21. The nozzle of claim 20, wherein said gas shroud tube is adapted to carry a gas at a lower pressure and higher flow rate than a gas being supplied though the center tube.

22. The nozzle of claim 21, wherein said outlet orifice is partially closed by a shroud partition.

23. A nozzle for forming nanofibers by using a pressurized gas stream, said nozzle comprising:

means for contacting a fiber-forming material with a gas within said nozzle, such that a plurality of strands of fiber-forming material are ejected from the nozzle, wherein said strands of fiber-forming material solidify and form nanofibers having a diameter up to about 3000 nanometers.

* * * * *